United States Patent [19]

Okubo et al.

[11] Patent Number: 5,007,870

[45] Date of Patent: Apr. 16, 1991

[54] JET PROPULSION CRAFT PROVIDED WITH EXHAUST NOISE ELIMINATING APPARATUS

[75] Inventors: Susumu Okubo; Yutaka Sasaki, both of Hamamatsu, Japan

[73] Assignee: Suzuki Jidosha Kogyo Kabushiki Kaisha, Kamimura, Japan

[21] Appl. No.: 369,174

[22] Filed: Jun. 21, 1989

[30] Foreign Application Priority Data

Jul. 6, 1988 [JP] Japan ..... 63-166933

[51] Int. Cl.[5] ..... B63H 21/32

[52] U.S. Cl. ..... 440/89

[58] Field of Search ..... 114/270; 440/88, 89; 60/310; 181/212, 221

[56] References Cited

U.S. PATENT DOCUMENTS

| | | | |
|---|---|---|---|
| 3,369,518 | 2/1968 | Jacobson | 440/88 |
| 3,948,206 | 4/1976 | Tyler | 114/270 |
| 4,002,136 | 1/1977 | Michalak | 440/89 |
| 4,631,032 | 12/1986 | Nishida | 440/89 |

*Primary Examiner*—Joseph F. Peters, Jr.
*Assistant Examiner*—Jesûs Sotelo
*Attorney, Agent, or Firm*—Schwartz & Weinrieb

[57] ABSTRACT

A jet propulsion craft propelled upon a water surface generally comprises a hull structure comprising a bottom plate and an upper plate, an engine mounted upon the bottom plate at substantially a middle portion of the hull structure as considered in the longitudinal direction thereof, the engine being provided with an exhaust port, an exhaust system extending rearwardly from the engine and provided with an inlet end and an outlet end, the inlet end being operatively connected to the engine exhaust gas discharging port, and a jet pump mounted upon the bottom plate at a rear portion of the hull structure and driven by means of the engine. An exhaust gas noise eliminating device operatively connected to the outlet end of the exhaust system is further provided for the craft for eliminating the exhaust gas noise in a stepwise manner. The exhaust gas noise eliminating device comprises a hollow guard plate mounted upon the bottom plate at the rear portion of the hull structure and the inner hollow portion thereof is divided into a plurality of expansion chambers. The exhaust gas noise eliminating device may also comprise a box like member mounted upon a rear end portion of the hull structure and the inner hollow portion thereof may be divided into a plurality of expansion chambers.

15 Claims, 4 Drawing Sheets

JET PROPULSION CRAFT PROVIDED WITH EXHAUST NOISE ELIMINATING APPARATUS

FIELD OF THE INVENTION

This invention relates to a jet propulsion craft propelled upon the water surface by means of water ejected from a jet pump means of the craft and, more particularly, to an exhaust noise eliminating apparatus mounted upon the jet proplusion craft.

BACKGROUND OF THE INVENTION

Recently, there has been widely utilized a jet propulsion craft of the small recreational propelled upon the surface of water, particularly, sea water, by means of water ejected from a jet pump accommodated within the craft.

Such a jet propulsion craft or ship comprises a main body generally composed of a bottom plate generally having a curved shape in cross section and an upper plate constituting an upper deck. An engine is mounted upon the bottom plate at substantially the middle portion thereof and a jet pump is connected to the engine so as to be driven thereby and is mounted upon the rear portion of the bottom plate.

A user, that is, a driver rides upon the rear portion of the upper plate of the craft and operates a steering handle, so as to drive the craft, which is mounted to the upper plate so as to be adjustable in height with respect thereto.

When the user drives the craft, water, preferably sea water, is introduced into the jet pump by sucking the same through a suction port formed within the ship bottom plate and the inhaled water is then exhausted rearwardly from the jet pump, whereby the craft can be propelled forwardly upon the water surface.

With the jet propulsion craft of the type described, an exhaust system is also connected to the engine so as to extend forwardly of the craft or ship and the exhaust system includes a manifold connected to an exhaust port of the engine, and an exhaust muffler connected at one end thereof to the manifold and at the other end thereof to an exhaust outlet tube disposed at the front portion of the bottom plate. The exhaust gas from the engine is exhausted from the outlet tube and the noise of the exhaust gas is eliminated in a stepwise manner during the passage thereof through the exhaust system.

With the jet propulsion craft of the type having the construction described above, however, the outlet opening of the exhaust pipe is opened at a position located above the water surface and, hence, the exhaust gas is exhausted into the atmosphere with a considerably large amount of noise.

In order to substantially decrease the exhaust gas noise below the permissible level thereof, there is also proposed a jet propulsion craft provided with an exhaust system which includes an additional muffler operatively connected to the outlet tube. The location of the additional muffler, however, renders the exhaust system complicated and occupies additional space as well as increases the manufacturing cost.

In another aspect of the prior art, there has also been proposed a jet propulsion craft such as that disclosed in the Japanese Patent Laid-open Publication No. 62-125995, in which an exhust system for an exhaust gas from an engine extends rearwardly. The exhaust gas from the engine is guided through the exhaust system into a cylindrical member in which a jet pump is accommodated. With the jet propulsion craft of this type, it is necessary to design the cylindrical member so as to ensure a large space for the purpose described above, which is not advantageous for the craft from the viewpoints of the hull construction and the manufacturing cost, and even in connection with such construction, the noise of the exhaust gas is still not sufficiently eliminated.

The prior art has further proposed a marine exhaust system for a boat as disclosed in the U.S. Pat. No. 4,002,136, in which an exhaust chamber is additionally located within the stern of the boat and is connected to the engine exhaust manifold. A submerged exhaust port emits the exhaust gas below the water level so as to silence the exhaust noise. With this exhaust system, the exhaust chamber is additionally located within the space defined between the bottom plate and the upper plate at the stern portion of the boat, which is not desired for optimum hull construction as well as the manufacturing cost thereof. Even in connection with the structure described, the noise of the exhaust gas may not be sufficiently eliminated.

OBJECTS OF THE INVENTION

An object of this invention is to substantially eliminate the defects or drawbacks of the conventional technology and to provide a jet propulsion craft having a simplified structure for eliminating the exhaust gas noise from an engine.

Another object of this invention is to provide a jet propulsion craft provided with an improved exhaust gas noise eliminating structure capable of substantially eliminating the exhaust gas noise which is discharged outwardly from the craft.

SUMMARY OF THE INVENTION

These and other objects can be achieved according to this invention by providing a jet propulsion craft for propulsion upon a water surface, comprising a hull structure generally comprising a bottom plate and an upper plate, an engine mounted upon the bottom plate at substantially a middle portion of the hull structure as considered in the longitudinal direction thereof, the engine being provided with a port through which engine exhaust gas is discharged, an exhaust system extending rearwardly from the engine and provided with an inlet end and an outlet end, the inlet end being operatively connected to the engine exhaust gas discharging port, a jet pump mounted upon the bottom plate at a rear portion of the hull structure and driven by means of the engine the jet pump being adapted to inhale water and exhaust the inhaled water outwardly as water for advancing the jet propulsion craft, an exhaust gas noise eliminating device connected to the outlet end of the exhaust system for eliminating the exhaust gas noise in a stepwise manner, and an exhaust gas discharging port operatively connected to the exhaust gas noise eliminating device.

In a preferred embodiment, the exhaust gas noise eliminating device comprises a hollow guard plate mounted upon the bottom plate at the rear portion of the hull structure for guarding the jet pump and provided with an inlet port formed within a front portion of the guard plate and in communication with the outlet end of the exhaust system, and an outlet port formed within a rear portion of the guard plate.

In accordance with another preferred embodiment, the exhaust gas noise eliminating device comprises a box like member mounted upon a rear end portion of the hull structure and provided with an inlet port and an outlet port, the inlet port being in communication with the outlet end of the exhaust system and the outlet port of the box like member being formed within a lower plate thereof so as to be directed downwardly.

According to this invention of the character described above, the jet propulsion craft is provided with an exhaust system operatively connected to the engine at one end and, at the other end, to the exhaust gas noise eliminating means. The exhaust gas from the engine is introduced into the exhaust system and then into the exhaust gas noise eliminating means. The exhaust gas noise eliminating means comprises hollow structure having an inner hollow space which is preferably divided into a plurality of expansion chambers so as to eliminate the exhaust gas noise in a stepwise manner during the time when the exhaust gas introduced into the exhaust gas noise elminating means is being conducted therethrough and discharged therefrom. According to the specific provision of the exhaust gas eliminating means, the exhaust system is made compact because the additional location of a muffler for eliminating the exhaust gas noise is significantly eliminated. The exhaust gas noise eliminating means can be easily applied to an existing jet propulsion craft without largely changing the design thereof, thus eliminating additional manufacturing costs.

BRIEF DESCRIPTION OF THE DRAWINGS

Various other objects, features, and attendant advantages of the present invention will become more fully appreciated from the following detailed description of the invention, when considered in connection with the accompanying drawings, in which like reference characters designate like or corresponding parts throughout the several views, and wherein.

DESCRIPTION OF THE ILLUSTRATED EMBODIMENTS

Figure 1A:
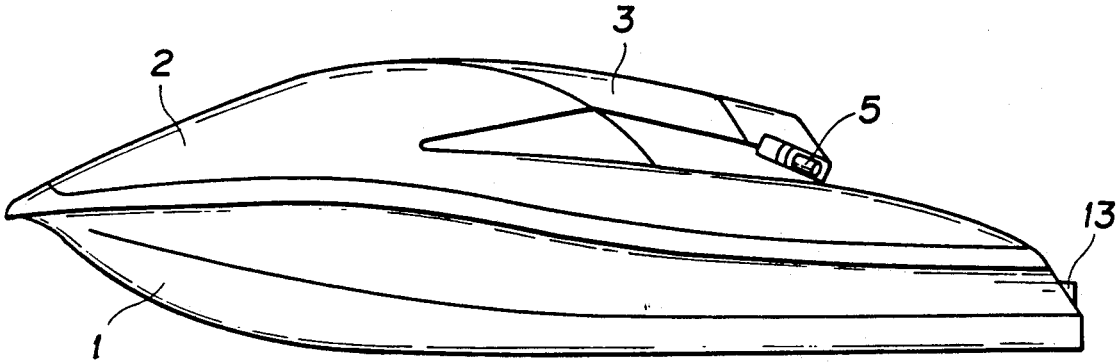
FIGS. 1A, 1B and 1C are side, bottom and rear views of a jet propulsion craft constructed in accordance with one embodiment of this invention, respectively.
Figure 1B:
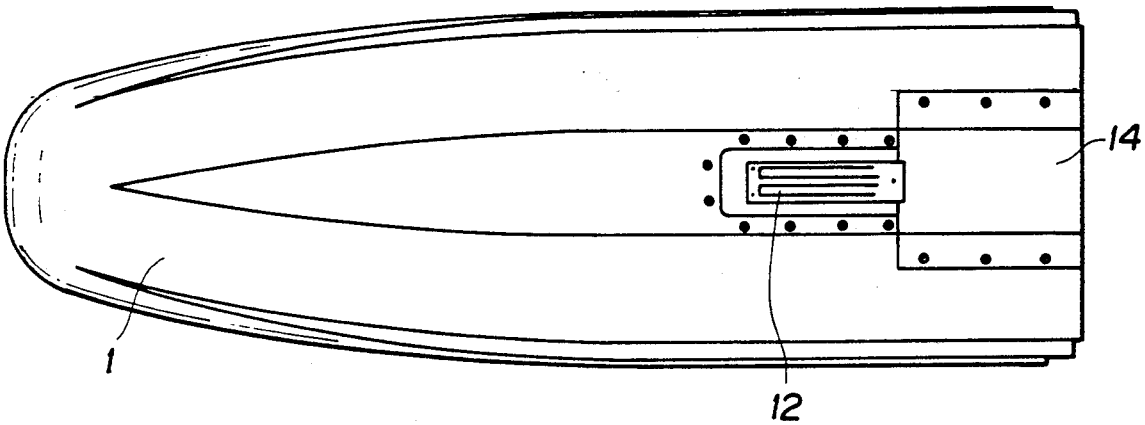
Figure 1C:
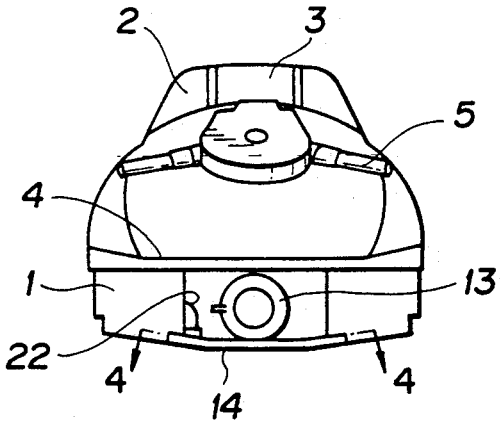

Referring to FIGS. 1A, 1B and 1C, respectively showing side, bottom and rear end views of a jet propulsion craft of the first embodiment constructed according to this invention, the jet propulsion craft is provided with a hull body comprising a bottom plate 1 having a substantially U-shaped cross section with a widened upper opening and an upper deck plate 2 mounted upon the bottom plate 1 so as to cover the opening thereof. A steering handle pole 3 is pivotably secured to the upper deck plate 2 so as to be adjustable in height with respect thereto.

A user riding upon a foot deck 4 formed within the upper deck 2 grips handles 5 secured to the handle pole 3 so as to drive the craft upon the surface of the sea water, for example. During the operation of the craft, the rider can steer the handle pole 3 so as to rotate the same while in the standing attitude.

Figure 2:
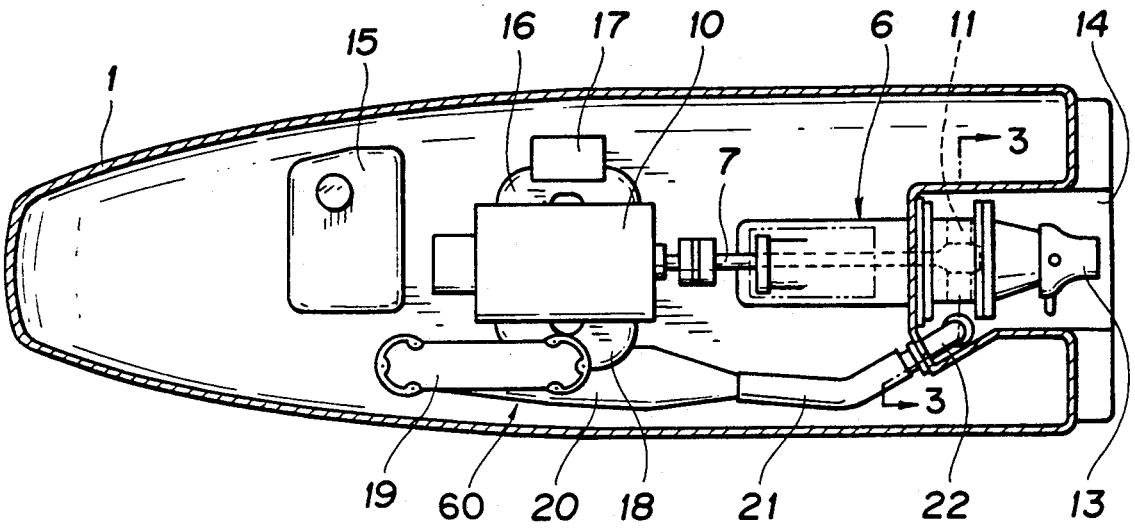
FIG. 2 is a plan view of the jet propulsion craft shown in FIG. 1 with the upper deck removed.

With the jet propulsion craft of the character described above, as shown in FIG. 2, a jet pump 6 is disposed at the rear portion of the bottom plate 1 and the jet pump 6 is provided with a channel, not shown, and a propeller 11 fixed to a propeller shaft 7 within the channel. The propeller shaft 7 is connected to an engine 10 mounted upon the middle portion of the bottom plate 1. According to this construction, when the engine 10 is driven, the propeller 11 is rotated through means of the rotation of the propeller shaft 7 so as to thereby ingest the sea water into the channel of the jet pump 6 through means of a water intake port 12 formed within the bottom plate 1 as shown in FIG. 1B. The water sucked into the channel of the jet pump 6 flows backwardly as a result of the rotation of the propeller 11 and is forcibly exhausted outwardly from a jet nozzle member 13 attached to the rear portion of the jet pump 6, whereby the jet propulsion craft is propelled over the water surface.

The jet nozzle member 13 is pivotably attached to the jet pump 6 in the widthwise direction of the craft. The jet pump 6 inclusive of the nozzle member 13 is protected from any effects of the water surface by means of a jet pump guard plate 14 as shown in FIG. 1B or 1C and as described in detail hereinafter. The guard plate 14 is mounted upon the rear portion of the bottom plate 1.

A fuel tank 15 is mounted upon the bottom plate 1 at a location in front of the engine 10. A carburetor 17 and the other members in association therewith are connected to the engine 10 through means of an inlet manifold 16. The carburetor 17, the inlet manifold 16 and the other associated members constitute an inlet system of the engine 10.

An engine exhaust system, generally designated by the reference numeral 60, comprises an exhaust manifold 18 connected to an exhaust port of the engine 10, a substantially U-shaped tube 19 connected to the exhaust manifold 18 and extending forwardly with respect to the bottom plate 1, an exhaust muffler 20 connected to the tube 19 and extending rearwardly with respect to the bottom plate 1, and an exhaust tail pipe 22 connected to the exhaust muffler 20 through means of an exhaust hose 21. The exhaust tail pipe 22 is coupled to the jet pump guard plate 14, which constitutes an exhaust noise eliminating member of a hollow structure, for example, in a preferred embodiment. As described, the exhaust system of the engine 10 of the jet propulsion craft of this invention is constituted by means of the described members inclusive of the exhaust manifold 18 and the jet pump guard plate 14.

Figure 3:
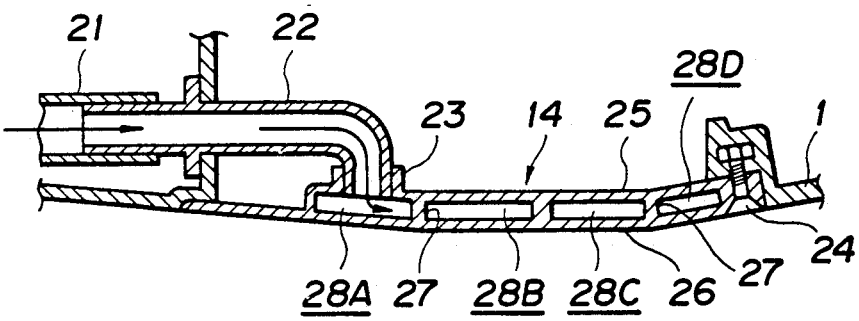
FIG. 3 is a sectional view of the craft taken along the line 3—3 shown in FIG. 2.

The exhaust tail pipe 22 is loosely fitted to a boss 23 of the guard plate 14 which is secured to the bottom plate 1 as shown in FIG. 3. The exhaust gas from the engine 10 is exhausted into the guard plate 14 after flowing through the exhaust system 60 while the exhaust noise of the exhaust gas is eliminated in a stepwise manner.

Figure 4:
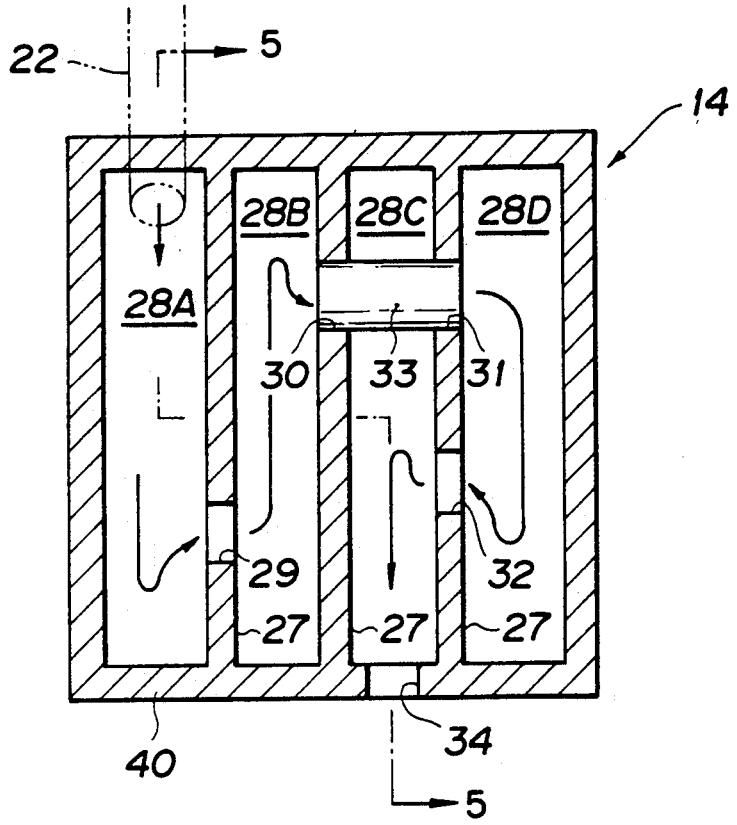
FIG. 4 is a sectional view taken along the line 4—4 shown in FIG. 1C

Namely, as shown in FIG. 3, the jet pump guard plate 14 comprises a flat hollow box structure constituted by mating an upper plate 25 and a lower plate 26 with a space defined therebetween so as to exhibit a flat box shape having an inner hollow portion which is divided into a plurality of small chambers by means of a plurality of partition plates 27 arranged in a parallel, in the illustrated embodiment, spaced relationship with respect to each other. These partition plates 27 divide the inner space of the guard plate 14 into a plurality of expansion chambers and, more particularly, as seen in the illustrated embodiment of FIG. 4, first, second, third and fourth expansion chambers 28A, 28B, 28C and 28D are formed.

The partition boards 27 are provided with exhaust noise eliminating openings 29, 30, and 31 and 32, respectively in such a manner that the first expansion chamber 28A communicates with the second expansion chamber 28B through means of the opening 29, and the third expansion chamber 28C communicates with the fourth expansion chamber 28D through means of the opening 32. An exhaust noise eliminating duct 33 is inserted into the openings 30 and 31 so that the second expansion chamber 28B communicates directly with the fourth expansion chamber 28D.

An exhaust port 34 is formed within a side wall of the guard plate 14 so as to communicate the third expansion chamber 28C with the atmosphere. The front end opening of the exhaust tail pipe 22 communicates with the first expansion chamber 28A.

According to the jet pump guard plate 14 having the structure described above and shown in detail in FIGS. 3 to 5, the exhaust gas from the engine 10 is introduced into the first expansion chamber 28A through means of the exhaust system 60 and then into the second expansion chamber 28B through means of the exhaust noise eliminating opening 29. The exhaust gas is then introduced into the fourth expansion chamber 28D through means of the duct 33 and, thereafter, into the third expansion chamber 28C through means of the opening 32 formed within the partition plate 27 separating chambers 28C and 28D. During this flow of the exhaust gas, the noise of the exhaust gas can be substantially eliminated and silenced in a stepwise manner. The exhaust gas introduced into the third expansion chamber 28C is then discharged outwardly through means of the exhaust port 34 with substantially all noise eliminated.

The jet pump guard plate 14 of the construction described above can thus attain the muffling effect as well as the silencing effect, so that it is not necessary to mount a second muffler means or additional exhaust gas noise eliminating equipment which is required in connection with the prior art exhaust systems for the effective elimination of the exhaust gas noise. Accordingly, the structure of the engine gas exhaust system of the present invention can be made compact and simplified with reduced cost.

In addition, in accordance with the preferred embodiment of this invention, the jet pump guard plate 14 is located beneath the jet pump 6 and the exhaust port 34 is formed within the rear portion of the guard plate 14. According to this location, the exhaust gas discharged from the port 34 is significantly mixed with the water exhausted outwardly from the nozzle member 13 of the jet pump 6. Thus, the exhaust gas noise eliminating effect can be further improved.

Furthermore, the rearward discharge of the exhaust gas within the guard plate 14 and through the port 34 will reduce the influence against the operator riding upon the deck portion.

Figure 6A:
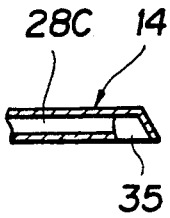
FIGS. 6A, 6B, and 6C are sectional views, partially broken, of a jet pump guard plate mounted upon the jet propulsion craft respectively representing modifications thereof.
Figure 6B:
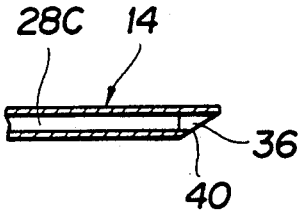
Figure 6C:
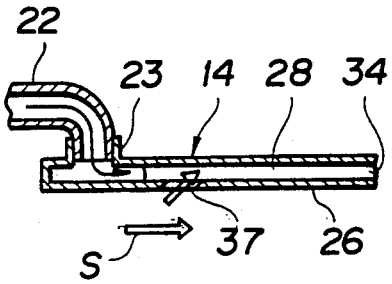

FIGS. 6A, 6B and 6C respectively show fragmentary sectional views of the first, second and third modifications of the jet pump guard plate 14 according to this invention.

In the first modification shown in FIG. 6A, an exhaust port 35 is formed within the lower portion of the rear part of the guard plate 14 and is directed downwardly so that the exhaust gas from the exhaust port 35 is forcibly included or mixed with the exhausted water from the jet nozzle member 13 of the jet pump 6, whereby the noise eliminating effect of the exhaust gas can be improved still further.

In the second modification shown in FIG. 6B, an exhaust port 36 is formed within the rear end portion 40 of the guard plate 14 and directed obliquely rearwardly so as to exhaust the gas obliquely downwardly in the rearward direction, whereby the gas exhausted from the port 36 is effectively included within the water exhausted from the jet nozzle member 13 whereby the noise eliminating effect of the exhaust gas can also be improved.

Figure 5:
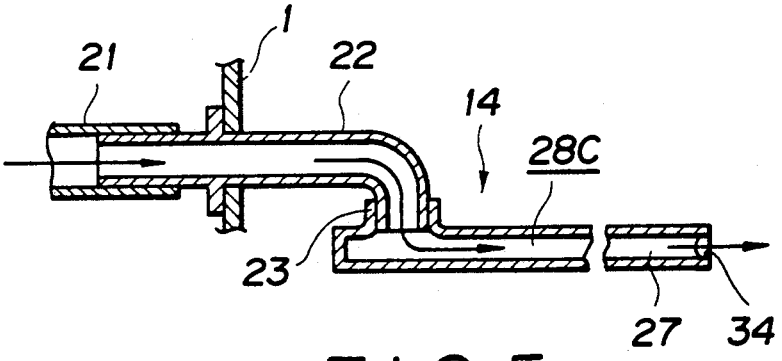
FIG. 5 is a sectional view taken along the line 5—5 shown in FIG. 4.

In the third modification shown in FIG. 6C, the guard plate 14 is provided with an exhaust port 34 having a shape substantially the same as that shown in FIG. 5, but this modification is further provided with at least one water inlet hole 37 formed within the lower plate 26 of the guard plate 14 so as to positively ingest a portion of the water flow, into the expansion chamber 28 of the guard plate 14, flowing in the arrowed direction S relative to the advancing direction of the jet propulsion craft. The water ingested through means of the holes 37 into the chamber 28 is mixed with the exhaust gas therein, whereby the exhaust gas noise eliminating effect can be further remarkably improved.

Figure 7:
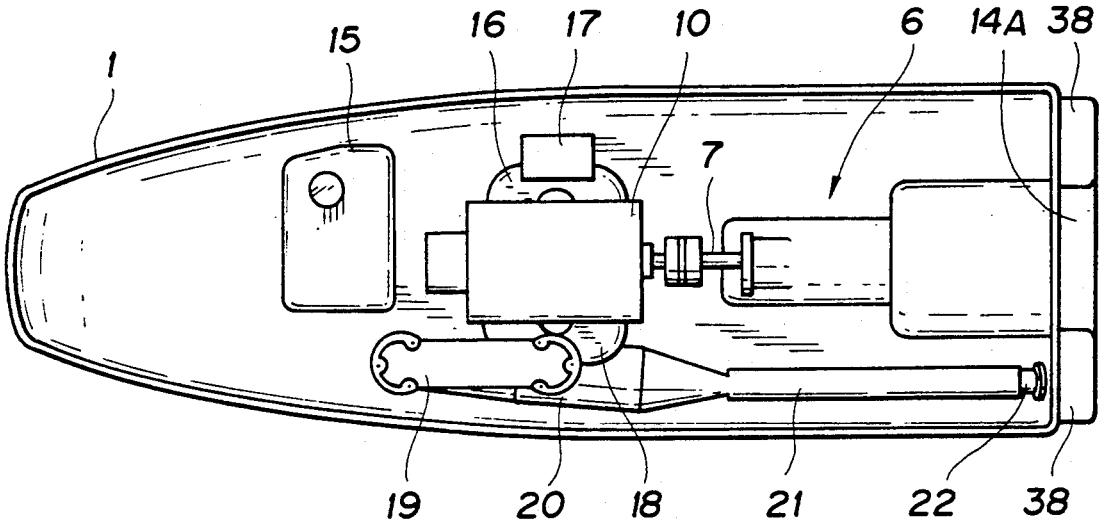
FIGS. 7 and 8 are plan and side views of another embodiment of the jet propulsion craft constructed according to this invention.
Figure 8:
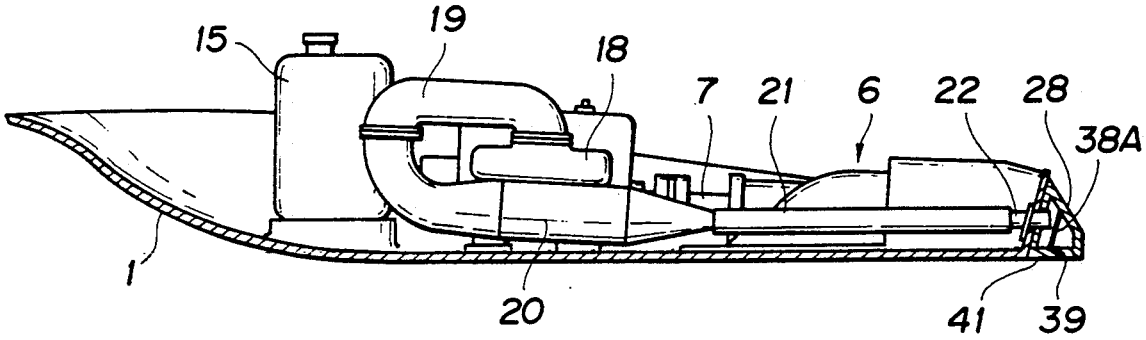

FIGS. 7 and 8 represent the second embodiment constructed according to this invention and such views are a plan view and a side view partially in section, respectively, in which like reference numerals are added to portions or members corresponding to those used for the first embodiment shown in FIGS. 1 to 6 whereby a detailed description thereof is now omitted herefrom.

In accordance with the second embodiment, the noise eliminating means for the exhaust gas is constructed as an exhaust gas eliminating box 38 mounted upon the rear end portion of the bottom plate 1 and defines space which extends in the widthwise direction of the craft.

In accordance with the second embodiment, the exhaust tail pipe 22 is connected to the exhaust noise eliminating box 38 so as to introduce the exhaust gas thereinto. The box 38 is provided as an exhaust port 39 formed with opening within the lower plate 41 of the box 38 so as to discharge the exhaust gas outwardly after performance of the exhaust gas noise eliminating function.

In a preferred modification of the second embodiment, two exhaust gas eliminating boxes 38 may be disposed upon both sides of the rear end portion of the craft and these boxes may communicate with each other through the guard plate 14A which may be provided with an internally hollow portion which is interposed between the two boxes 38.

In accordance with this second embodiment, as was the case with the first embodiment, it is not necessary to locate an additional muffler as is required within the conventional jet propulsion craft, thus simplifying the construction thereof and reducing the manufacturing cost.

In addition, the exhaust port 39 is open at the lower plate of the noise eliminating box 38, so that the exhaust gas from the port 39 is discharged together with the jet water from the nozzle member 13, which is not shown in FIG. 7, whereby the exhaust noise eliminating effect can be further improved. Furthermore, a plurality of partition plates 38A of the character described with reference to the first embodiment may be disposed within the exhaust noise eliminating box 38 so as to define a plurality of expansion chambers, whereby the exhaust gas noise can be further reduced.

According to this embodiment, the box or boxes 38 may be attached to the rear end of an existing jet propulsion craft without substantially changing the design of the conventional craft.

It is to be understood that this invention is not limited to the described embodiments and many other modifications and changes may be made without departing from the scope and spirit of the appended claims.

What is claimed is:

1. A jet propulsion craft for propulsion upon a water surface, comprising:

a hull structure generally comprising a bottom plate and an upper plate;

an engine mounted upon said bottom plate at substantially a middle portion of said hull structure as considered in the longitudinal direction thereof, said engine being provided with an exhaust port;

an exhaust system extending rearwardly from said engine and provided with an inlet end and an outlet end, said inlet end being operatively connected to said engine exhaust port;

a jet pump mounted upon said bottom plate at a rear portion of said hull structure and driven by said engine, said jet pump being adapted to ingest water and to exhaust said ingested water outwardly as a water jet from a jet nozzle for propelling said jet propulsion craft with respect to said water surface;

an exhaust gas noise eliminating means operatively connected to said outlet end of said exhaust system and mounted upon a rear portion of said hull within the vicinity of said jet nozzle for eliminating said exhaust gas noise; and an exhaust gas discharging port operatively connected to said exhaust gas noise eliminating means for discharging said exhaust gas at reduced noise levels.

2. The jet propulsion craft according to claim 1, wherein said exhaust gas noise eliminating means comprises a hollow guard plate means mounted on said bottom plate at the rear portion of said hull structure for guarding said jet pump and provided with an inlet port formed in a front portion of said guard plate means and communicating with said outlet end of said exhaust system and an outlet port formed in a rear portion of said guard plate means.

3. The jet propulsion craft according to claim 2, wherein said hollow guard plate means is provided with partition means which divides an inner hollow portion of said guard plate means into plural stages of exhaust gas expansion chambers which are in communication with each other through an opening formed in said partition plate means.

4. The jet propulsion craft according to claim 3, wherein said exhaust gas outlet port is formed in association with the last stage of the exhaust gas expansion chambers.

5. The jet propulsion craft according to claim 3, wherein said partition means comprises a plurality of partition plates which divide the inner hollow portion of said guard plate means into plural stages of exhaust gas expansion chambers which are in communications with each other in a predetermined order.

6. The jet propulsion craft according to claim 5, wherein said exhaust gas outlet port is formed in association with the last stage of the exhaust gas expansion chambers.

7. A craft as set forth in claim 3, wherein:

said partition means comprises three partition plates dividing said guard plate means into four expansion chambers.

8. A craft as set forth in claim 7, wherein:

each one of said partition plates is provided with at least one aperture for providing communication between said expansion chambers.

9. A craft as set forth in claim 8, wherein:

first and second ones of said three partition plates are provided with one aperture, a third one of said three partition plates is provided with two apertures, and duct means interconnects said one aperture of said second partition plate with one of said two apertures of said third partition plate such that said exhaust gas is conducted within said guard plate means from said inlet port, through a first one of said four expansion chambers, through said one aperture of said first partition plate and into a second one of said four expansion chambers, through said duct means into a fourth one of said four expansion chambers, through a second one of said two apertures of said third partition plate and into a third one of said four expansion chambers, and out said outlet port of said guard plate means.

10. The jet propulsion craft according to claim 2, wherein said outlet port is provided with an opening which is oriented so as to discharge said exhaust gas directly downwardly.

11. The jet propulsion craft according to claim 2, wherein said outlet port is provided with an opening which is directed obliquely downwardly in a rearward direction of said hull structure.

12. The jet propulsion craft according to claim 2, wherein said guard plate means is provided with a lower plate facing said water surface upon which the craft moves, said lower plate being provided with at least one opening through which the water is introduced into the inner hollow portion of said guard plate means.

13. The jet propulsion craft according to claim 1, wherein said exhaust gas noise eliminating means comprises box means mounted upon a rear end portion of said hull structure and provided with an inlet port and an outlet port, said inlet port being in communication with said outlet end of said exhaust system and said outlet port of the box means being formed in a lower plate thereof so as to be directed downwardly.

14. The jet propulsion craft according to claim 13, wherein said box means comprises two boxes separated in a widthwise direction of said hull structure and in communication with each other.

15. The jet propulsion craft according to claim 13, wherein an inner hollow portion of said box means is divided into a plurality of expansion chambers by partition means so as to communicate with each other in a predetermined order.

* * * * *